US010455911B1

(12) United States Patent
Sendi

(10) Patent No.: US 10,455,911 B1
(45) Date of Patent: Oct. 29, 2019

(54) AUTOMATED UMBRELLA ASSEMBLY

(71) Applicant: Joseph Sendi, Macomb, MI (US)

(72) Inventor: Joseph Sendi, Macomb, MI (US)

( * ) Notice: Subject to any disclaimer, the term of this patent is extended or adjusted under 35 U.S.C. 154(b) by 0 days.

(21) Appl. No.: 15/944,906

(22) Filed: Apr. 4, 2018

(51) Int. Cl.
*A45B 17/00* (2006.01)
*A45B 25/14* (2006.01)
*A45B 25/00* (2006.01)

(52) U.S. Cl.
CPC ..... *A45B 17/00* (2013.01); *A45B 25/143* (2013.01); *A45B 2017/005* (2013.01); *A45B 2025/003* (2013.01); *A45B 2200/1009* (2013.01)

(58) Field of Classification Search
CPC ..... A45B 17/00; A45B 25/14; A45B 25/143; A45B 2017/005; A45B 2025/003; A45B 2200/1009
See application file for complete search history.

(56) References Cited

U.S. PATENT DOCUMENTS 6,058,951 A 5/2000 Wilson
6,439,249 B1 8/2002 Pan et al.
6,923,193 B2 8/2005 Chen
7,017,598 B2 3/2006 Nipke
7,128,076 B2 * 10/2006 Freedman ..... A45B 11/00 135/20.3
7,188,633 B2 3/2007 Zerillo
7,562,666 B2 * 7/2009 Chan ..... A45B 25/143 135/16
7,997,290 B2 * 8/2011 Stoelinga ..... A45B 25/14 135/20.3
8,104,491 B2 * 1/2012 Li ..... A45B 23/00 135/16
8,522,804 B1 * 9/2013 Tung ..... A45B 25/14 135/20.1
8,757,183 B2 * 6/2014 Volin ..... A45B 25/143 135/20.3
8,763,620 B1 * 7/2014 Tung ..... A45B 25/14 135/20.1
8,857,453 B2 * 10/2014 Souma ..... A45B 25/143 135/20.3
9,185,988 B1 * 11/2015 Sanchez ..... A47C 7/66
9,820,540 B2 * 11/2017 Pan ..... A45B 25/00
2004/0035452 A1 * 2/2004 Ma ..... A45B 17/00 135/20.3
2004/0040591 A1 3/2004 Ma
2005/0072451 A1 4/2005 Vivian
2005/0166950 A1 * 8/2005 Grady, II ..... A45B 25/143 135/75

(Continued)

*Primary Examiner* — Noah Chandler Hawk

(57) ABSTRACT

An automated umbrella assembly includes an umbrella that is positionable between a deployed position and a stored position. A worm gear is rotatably coupled to the umbrella for urging the umbrella between the deployed position and the stored position. A pole is provided and the umbrella is pivotally coupled to the pole. A base insertably receives the pole such that the umbrella is spaced from the base. A control circuit is positioned in the pole and a worm gear motor is coupled to the umbrella. The worm gear is rotatably coupled to the worm gear motor and the worm gear motor is electrically coupled to the control circuit. The worm gear motor rotates the worm gear in a first direction to urge the umbrella into the stored position. The worm gear motor rotates the worm gear in a second direction to urge the umbrella the deployed position.

15 Claims, 8 Drawing Sheets

(56) References Cited

U.S. PATENT DOCUMENTS

| | | | | |
|---|---|---|---|---|
| 2006/0151019 | A1* | 7/2006 | Lo | A45B 25/165<br>135/20.3 |
| 2006/0254636 | A1 | 11/2006 | Tung | |
| 2007/0283987 | A1 | 12/2007 | Reyes | |

* cited by examiner

AUTOMATED UMBRELLA ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to umbrella devices and more particularly pertains to a new umbrella device for PURPOSE.

BRIEF SUMMARY OF THE INVENTION

An embodiment of the disclosure meets the needs presented above by generally comprising an umbrella that is positionable between a deployed position and a stored position. A worm gear is rotatably coupled to the umbrella for urging the umbrella between the deployed position and the stored position. A pole is provided and the umbrella is pivotally coupled to the pole. A base insertably receives the pole such that the umbrella is spaced from the base. A control circuit is positioned in the pole and a worm gear motor is coupled to the umbrella. The worm gear is rotatably coupled to the worm gear motor and the worm gear motor is electrically coupled to the control circuit. The worm gear motor rotates the worm gear in a first direction to urge the umbrella into the stored position. The worm gear motor rotates the worm gear in a second direction to urge the umbrella the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
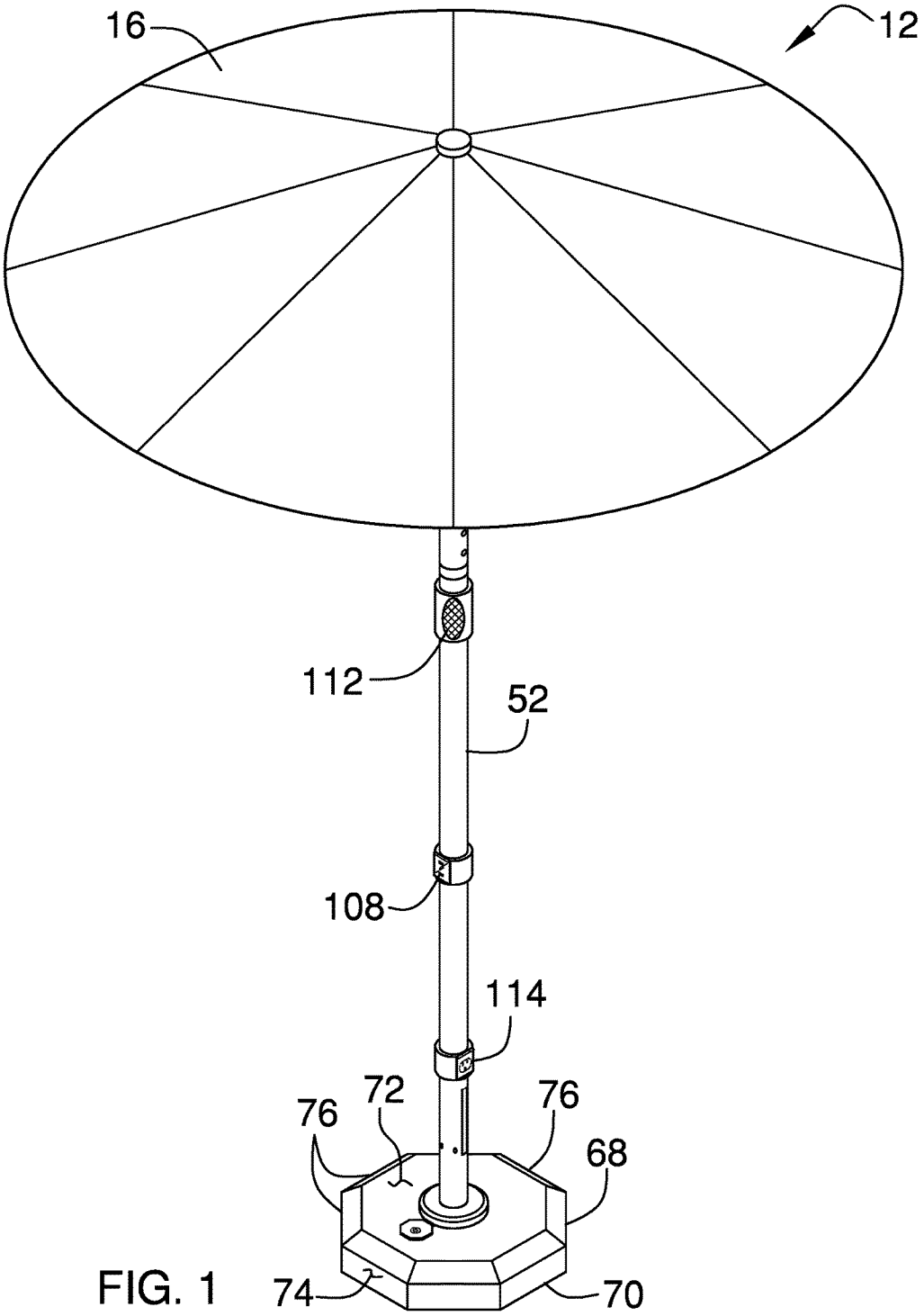
FIG. 1 is a top perspective view of an automated umbrella assembly according to an embodiment of the disclosure.
Figure 2:
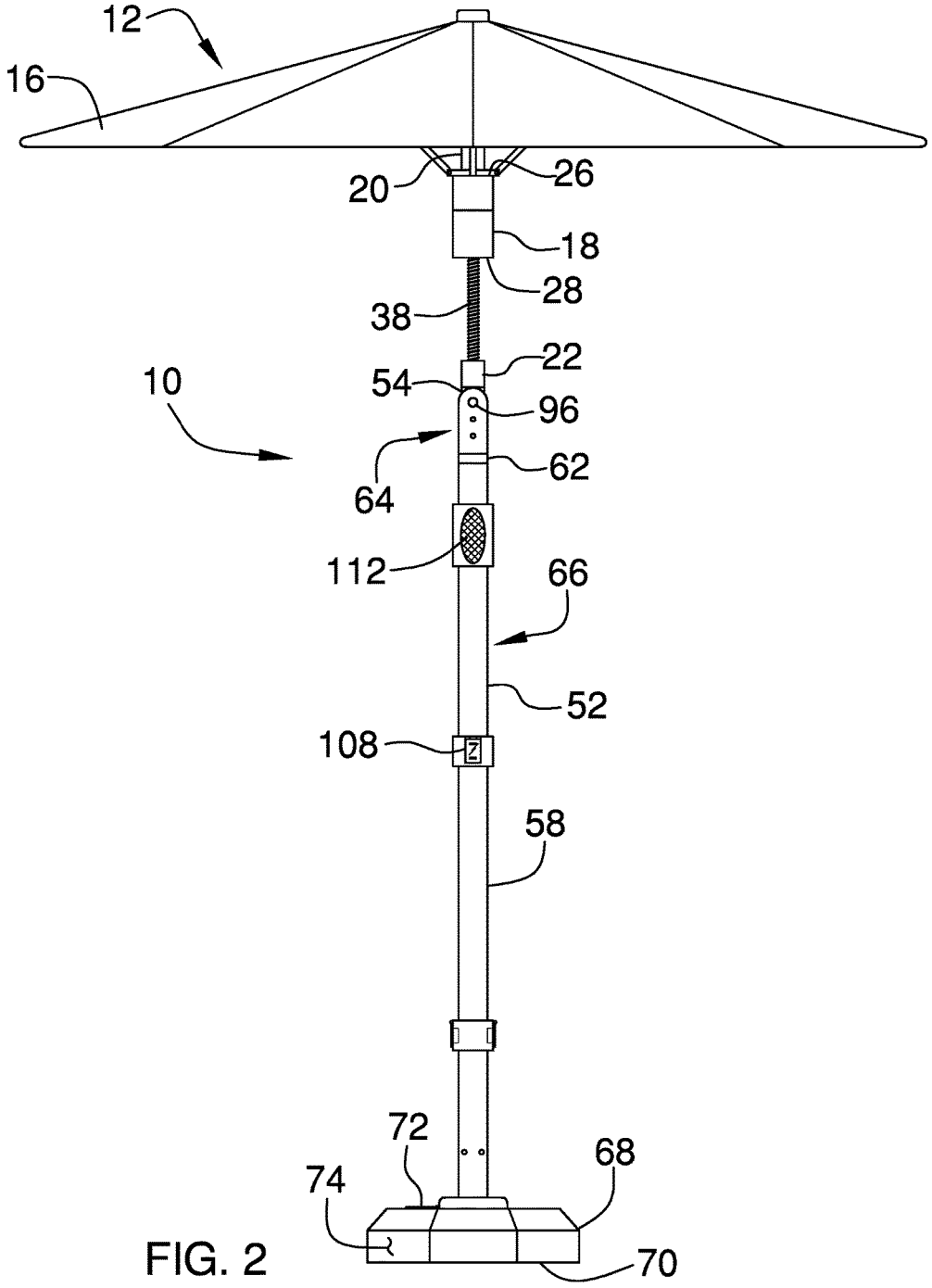
FIG. 2 is a front view of an embodiment of the disclosure.
Figure 3:
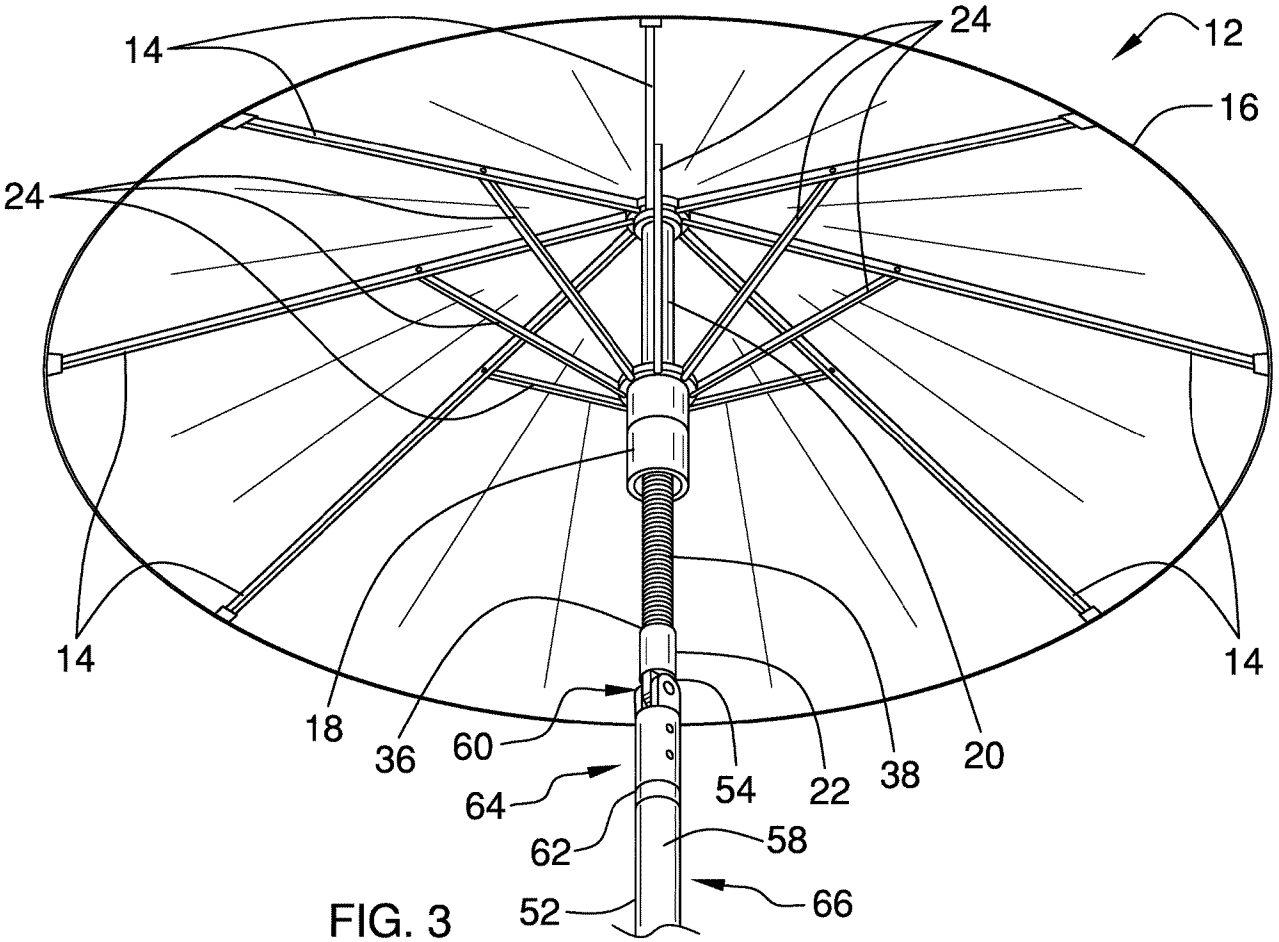
FIG. 3 is a bottom perspective view of an umbrella of an embodiment of the disclosure.
Figure 4:
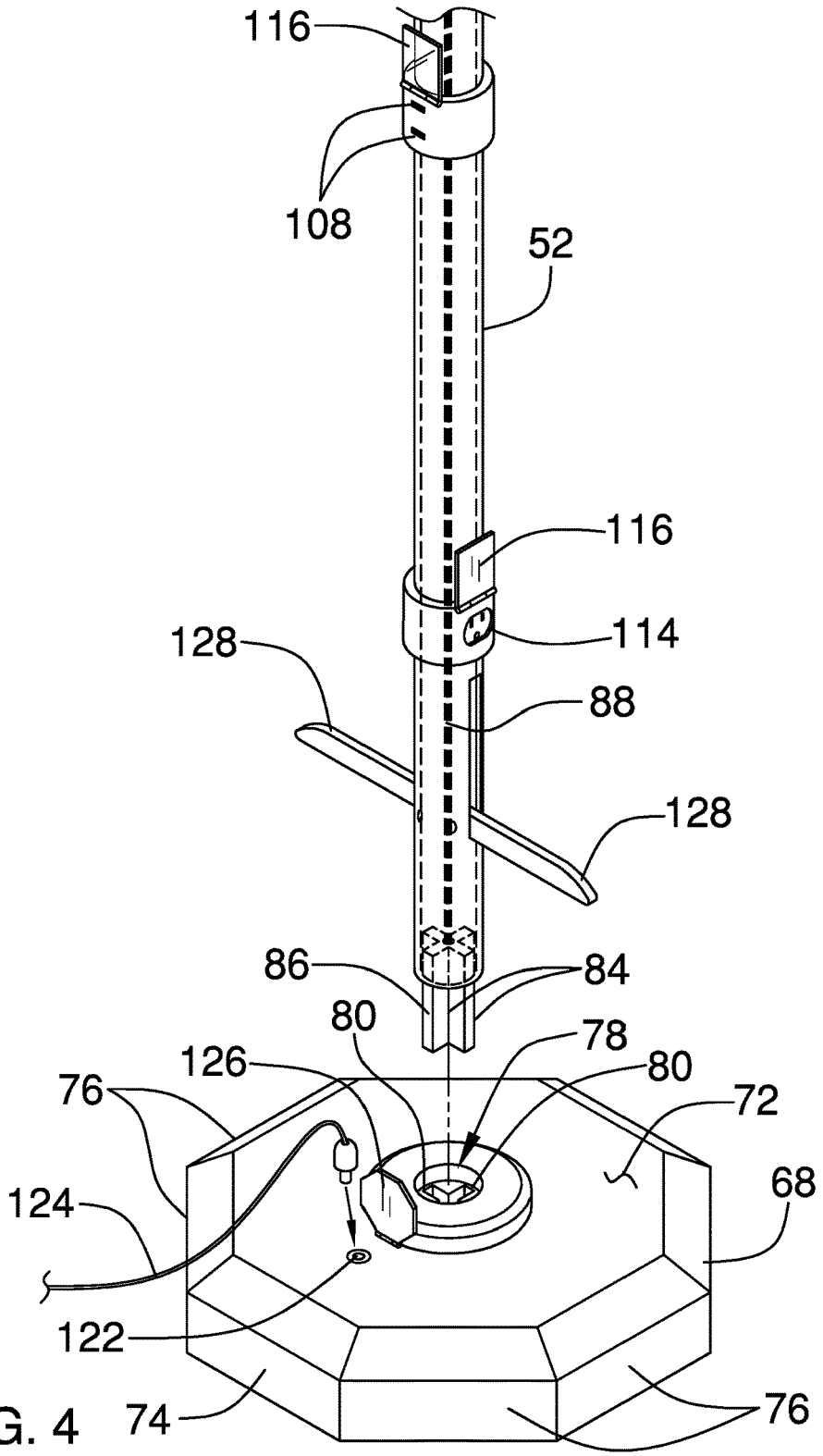
FIG. 4 is an exploded phantom view of a base and a pole of an embodiment of the disclosure.
Figure 5:
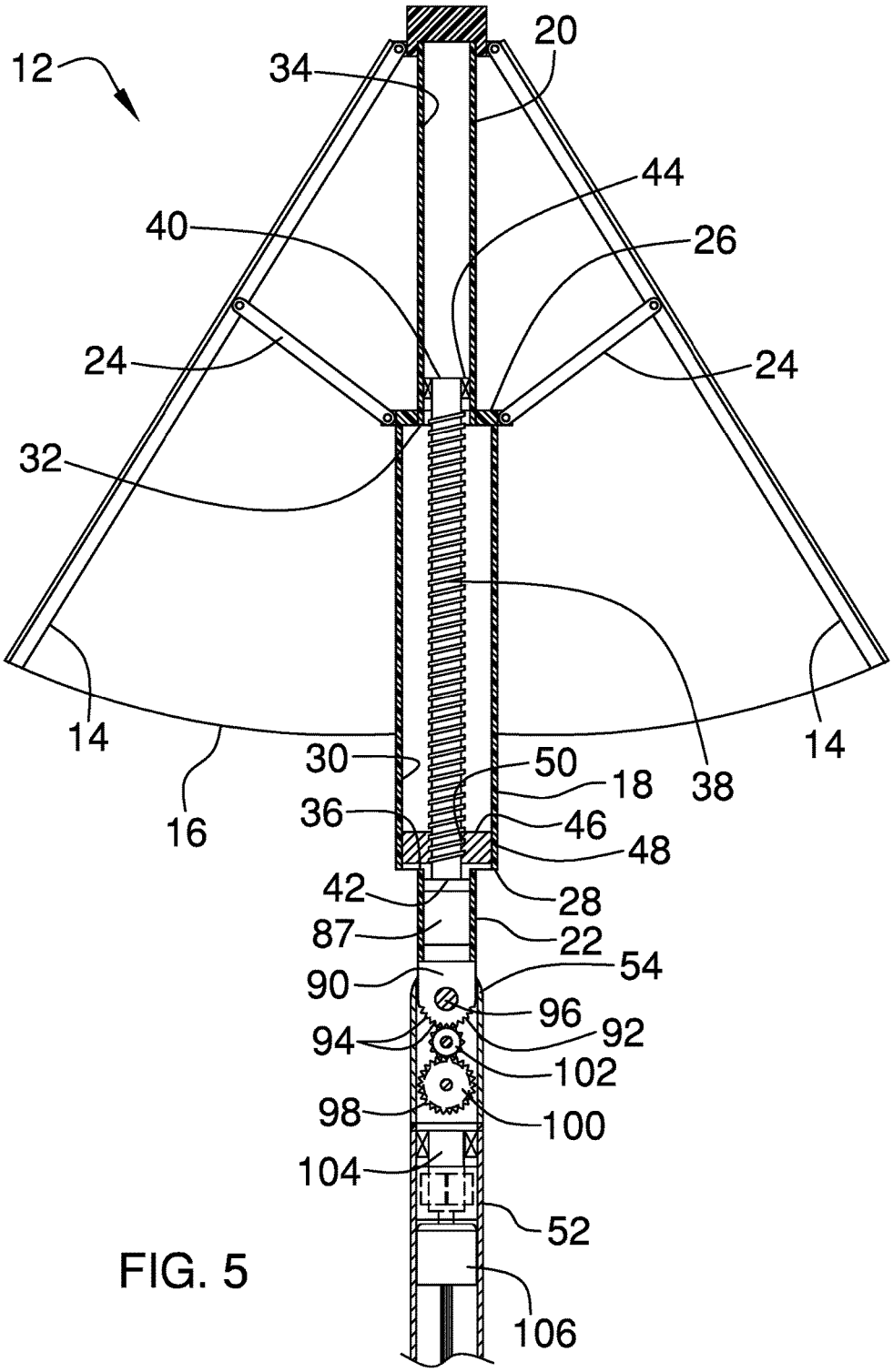
FIG. 5 is a cross sectional view taken along line 5-5 of FIG. 3 an embodiment of the disclosure.
Figure 6:
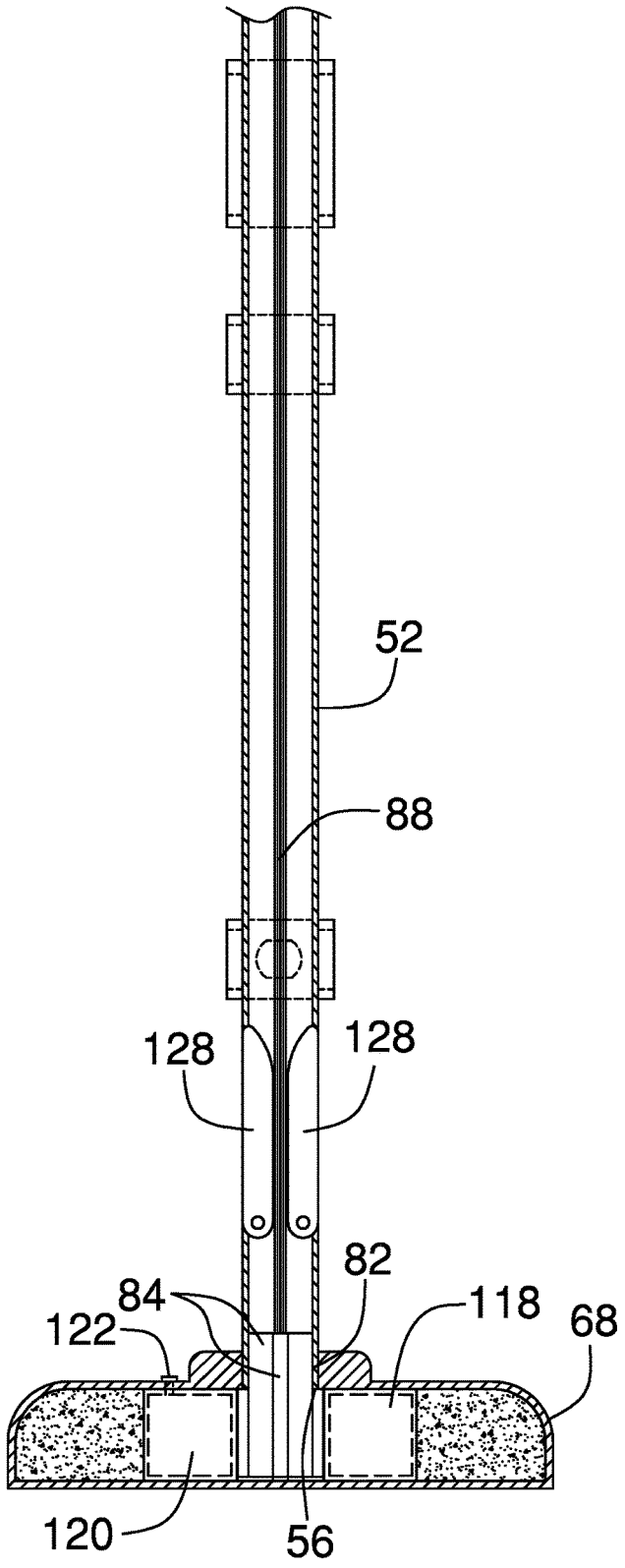
FIG. 6 is a cross sectional view taken along line 6-6 of FIG. 1 of an embodiment of the disclosure.

With reference now to the drawings, and in particular to FIGS. 1 through 8 thereof, a new umbrella device embodying the principles and concepts of an embodiment of the disclosure and generally designated by the reference numeral 10 will be described.

As best illustrated in FIGS. 1 through 8, the automated umbrella assembly 10 generally comprises an umbrella 12 that is positionable between a deployed position and a stored position. The umbrella 12 includes a plurality of ribs 14, a canopy 16 that is positioned on the ribs 14, a runner 18, a top tube 20, a bottom tube 22 and a plurality of stretchers 24. The runner 18 has a top end 26, a bottom end 28 and an interior surface 30, and each of the stretchers 24 is pivotally coupled between the top end 26 of the runner 18 and a respective one of the ribs 14. The runner 18 is slidably positioned around the top tube 20 for sliding upwardly and downwardly along the top tube 20 when the umbrella 12 is positioned between the deployed position and the stored position. The top tube 20 has a lower end 32 and an inside surface 34, and the bottom tube 22 has an upper end 36. Moreover, the lower end 32 of the top tube 20 is aligned with and is spaced from the upper end 36 of the bottom tube 22.

A worm gear 38 is provided and the worm gear 38 is rotatably coupled to the umbrella 12 for urging the umbrella 12 between the deployed position and the stored position. The worm gear 38 extends between the bottom tube 22 and the top tube 20 and the worm gear 38 is rotatable 134 in a first direction and a second direction. The worm gear 38 has a top end 40 and a bottom end 42, and the top end 40 of the worm gear 38 is rotatably coupled to the inside surface 34 of the top tube 20. A bearing 44 or the like is coupled between the top end 40 of the worm gear 38 and the inside surface 34 of the top tube 20. In this way the worm gear 38 is coupled to the top tube 20 while still being able to rotate independently of the top tube 20.

The runner 18 threadably engages the worm gear 38. Thus, the runner 18 is urged upwardly along the worm gear 38 when the worm gear 38 is rotated in the first direction for urging the umbrella 12 into the stored position. Additionally, the runner 18 is urged downwardly along the worm gear 38 when the worm gear 38 is rotated in the second direction for urging the umbrella 12 into the deployed position. A washer 46 is included that has an outer surface 48 and an inner surface 50. The outer surface 48 is coupled to the interior surface 30 of the runner 18 and the washer 46 is aligned with the bottom end 28 of the runner 18. The worm gear 38 extends through the washer 46 having the inner surface 50 of the washer 46 threadably engaging the worm gear 38.

A pole 52 is provided and the umbrella 12 is pivotally coupled to the pole 52. The pole 52 has an uppermost end 54, a lowermost end 56 and an outer wall 58 extending therebetween. Moreover, the pole 52 is hollow and each of the uppermost end 54 and the lowermost end 56 is open. The uppermost end 54 has a notch 60 extending downwardly towards the lowermost end 56 and outer wall 58 of the pole 52 has it cut 62 therein. The cut 62 extends around an entire circumference of the pole 52 to define a top portion 64 of the pole 52 and a bottom portion 66 of the pole 52.

A base 68 is provided and the base 68 insertably receives the pole 52 such that the umbrella 12 is spaced from the base 68. The base 68 has a bottom surface 70, a top surface 72 and an outer surface 74 extending therebetween. The outer surface 74 of the base 68 has a plurality of intersecting sides 76 such that the base 68 has an octagonal cross-section taken along a line extending through the bottom surface 70 of the base 68 and the top surface 72 of the base 68. The top surface 72 of the base 68 has a well 78 extending towards the bottom surface 70 and the well 78 is centrally positioned on the top surface 72. The well 78 insertably receives the lowermost end 56 of the pole 52 having the pole 52 extending upwardly from the base 68.

The well 78 comprises a pair of intersecting channels 80 that define a plus shape. The lowermost end 56 of the pole 52 has a retainer 82 coupled thereto and the retainer 82 has a pair of intersecting panels 84 such the retainer 82 has a plus shape. Each of the intersecting panels 84 extends into a respective one of the intersecting channels 80 such that the pole 52 is inhibited from rotating in the well 78. The base 68 contains a weighted material, such as sand or concrete, thereby inhibiting the base 68 from tipping from the weight of the umbrella 12. The retainer 82 is comprised of an electrically conductive material and the bounding surface of the well 78 is comprised of an electrically conductive material. Thus, the retainer 82 is in electrical communication with the bounding surface of the well 78 when the retainer 82 is positioned in the well 78.

A control circuit 86 is positioned in the pole 52 and a worm gear motor 87 is positioned within the bottom tube 22 of the umbrella 12. A plurality of conductors 88 is electrically coupled between the retainer 82 and the control circuit 86. The bottom end 42 of the worm gear 38 is rotatably coupled to the worm gear motor 87 and the worm gear motor 87 is electrically coupled to the control circuit 86. The worm gear motor 87 rotates the worm gear 38 in the first direction when the worm gear motor 87 is turned on to rotate in a first direction. Additionally, the worm gear motor 87 rotates the worm gear 38 in the second direction when the worm gear motor 87 is turned on to rotate in a second direction. The worm gear motor 87 may comprise an electric motor or the like.

A tab 90 is coupled to and extends downwardly from the lower end 32 of the top tube 20 of the umbrella 12. The tab 90 is positioned in the notch 60 in the uppermost end 54 of the pole 52 and the tab 90 has a distal end 92 with respect to the lower end 32 of the top tube 20. The distal end 92 is concavely arcuate with respect to the top tube 20. Moreover, the distal end 92 comprises a plurality of teeth 94. A pin 96 extends through the pole 52 and the tab 90 such that the top tube 20 of the umbrella 12 is pivotally coupled to the pole 52.

A first gear 98 is positioned within the pole 52 and a tilt motor 100 is positioned within the pole 52. The tilt motor 100 is electrically coupled to the control circuit 86 and the first gear 98 is rotatably coupled to the tilt motor 100. The tilt motor 100 rotates the first gear 98 in a first direction when the tilt motor 100 is turned on to rotate in a first direction. The tilt motor 100 rotates the first gear 98 in a second direction when the tilt motor 100 is turned on to rotate in a second direction. The tilt motor 100 may be an electric motor or the like. A second gear 102 is rotatably positioned within said pole 52 and the second gear 102 engages the first gear 98 and the teeth 94 on the tab 90. Thus, the tab 90 rotates about the pin 96 when the tilt motor 100 is turned on for tilting the umbrella 12.

A gearbox 104 is positioned in the top portion 64 of the pole 52 and engages the top portion 64 of the pole 52. A rotation motor 106 is positioned in the bottom portion 66 of the pole 52 and the rotation motor 106 is electrically coupled to the control circuit 86. The gearbox 104 is rotatably coupled to the rotation motor 106. The gearbox 104 rotates the top portion 64 of the pole 52 about a vertical axis when the rotation motor 106 is turned on. In this way the umbrella 12 can be aligned with the sun, when the umbrella 12 is tilted, as the sun travels across the sky. The rotation motor 106 may be an electric motor or the like and the gearbox 104 may be any manner of mechanism that is capable of transferring rotational torque generated by the rotation motor 106 into the top portion 64 of the pole 52.

A plurality of input ports 108 is provided and each of the input ports 108 is coupled to the outer wall 58 of the pole 52. Each of the input ports 108 is electrically coupled to the control circuit 86 and each of the input ports 108 may be electrically coupled to an external electronic device 110 for receiving data from the external electronic device 110. Each of the input ports 108 may be a usb port or the like and the external electronic device 110 may be a smart phone, a personal computer and any other electronic device capable of storing audio data in electronic form. A speaker 112 is coupled to the outer wall 58 of the pole 52 and the speaker 112 is electrically coupled to the control circuit 86. Thus, the speaker 112 receives the data from the input ports 108 and the speaker 112 emits audible sounds outwardly from the pole 52.

An electrical outlet 114 is coupled to the outer wall 58 of the pole 52 and the electrical outlet 114 is electrically coupled to the control circuit 86. The external electronic device 110 may be electrically coupled to the electrical outlet 114 for powering the external electronic device 110. The electrical outlet 114 may be a three prong, female electrical outlet 114 or the like. A plurality of covers 116 is provided and each of the covers 116 is hingedly coupled to the pole 52. Each of the covers 116 is aligned with a respective one of the input ports 108 and the electrical outlet 114. In this way each of the covers 116 protects the respective input ports 108 and the respective electrical outlet 114 from moisture when the covers 116 are closed.

A power supply 118 is positioned within the base 68 and the power supply 118 is electrically coupled the bounding surface of the well 78. Thus, the power supply 118 is in electrical communication with the control circuit 86 when the retainer 82 is positioned in the well 78. The power supply 118 comprises at least one rechargeable battery 120 that is positioned within the base 68. The at least one rechargeable battery 120 is electrically coupled to the control circuit 86. A charge port 122 is coupled to the base 68 and the charge port 122 may be electrically coupled to a power source 124. The charge port 122 is electrically coupled to the at least one rechargeable battery 120 for charging the at least one rechargeable battery 120. Additionally, the power source 124 may be a battery charger or other source of electrical current. The charge port 122 includes a lid 126 that is hingedly coupled to the base 68 for selectively covering the charge port 122.

A pair of handles 128 is provided and each of the handles 128 is pivotally coupled to the pole 52. Each of the handles 128 is positionable in a stored position having each of the handles 128 being oriented collinear with and being recessed into the outer wall 58 of the pole 52. Each of the handles 128 is positionable in a deployed position having each of the handles 128 extending outwardly from the outer wall 58 of the pole 52 for gripping. Moreover, each of the handles 128 may be positioned on opposite sides of the pole 52 with respect to each other. A control 130 is coupled to the pole 52 and the control 130 is electrically coupled to the control circuit 86. The control 130 may comprise a plurality of buttons, and each of the buttons may control 130 operational parameters of a respective one of the worm gear motor 87, the tilt motor 100, the rotation motor 106 and the speaker 112.

Figure 7:
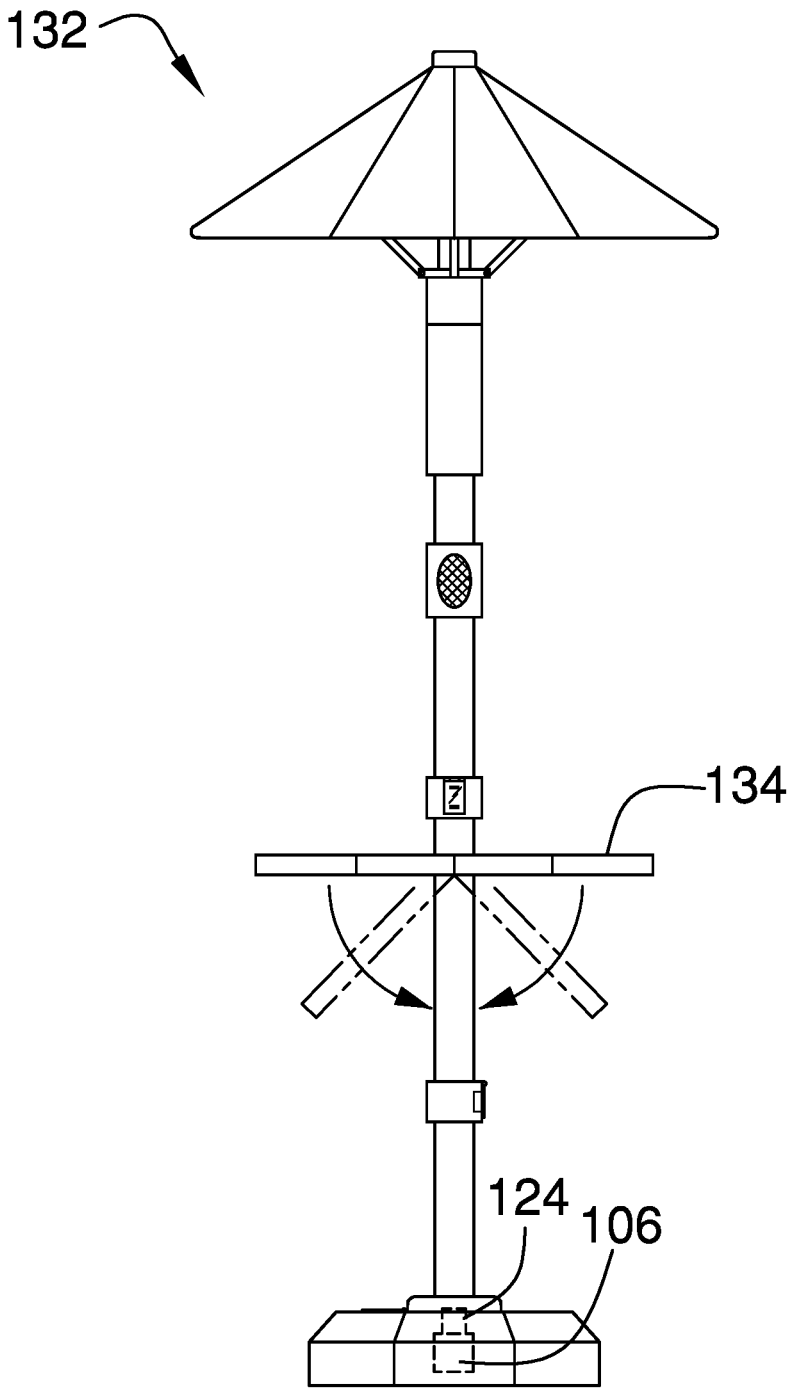
FIG. 7 is a front view of an alternative embodiment of the disclosure.
Figure 8:
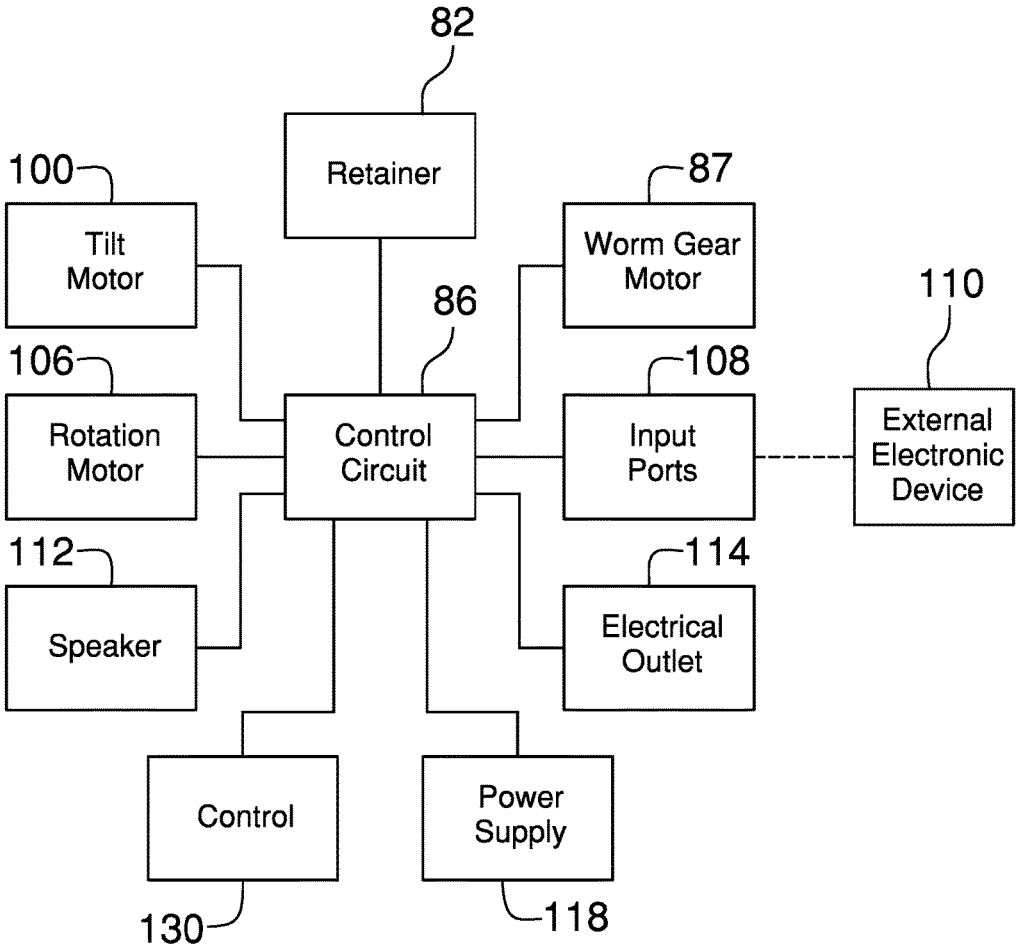
FIG. 8 is a schematic view of an embodiment of the disclosure.

In an alternative embodiment 132 as shown in FIG. 7, a table 134 may be pivotally coupled to the outer wall 58 of the pole 52. Additionally, the table 134 may comprise a plurality of sections that are distributed around the circumference of the pole 52. The table 134 may be horizontally oriented when the table 134 is positioned in a deployed position for supporting objects. Additionally, the table 134 may lie flat against the outer wall 58 of the pole 52 when the table 134 is positioned in a stored position. Continuing in the alternative embodiment 132 as shown in FIG. 7, the rotation motor 106 and the gearbox 124 may each be positioned within the base 68, and the gearbox 124 may engage the lowermost end 56 of the pole 52 for rotating the pole 52.

In use, worm gear motor 87 is turned on to rotate in the second direction to urge the runner 18 upwardly along the worm gear 38. Thus, the umbrella 12 is urged into the deployed position for providing shade from the sun or the block precipitation. Additionally, the tilt motor 100 is turned on to tilt the umbrella 12 into a selected angle with respect to the pole 52 when the sun is at a low angle during early morning hours or late afternoon hours. The rotation motor 106 is turned on to rotate the umbrella 12 on the pole 52 such that the umbrella 12 is aligned with the sun as the sun travels across the sky. The worm gear motor 87 is turned on to rotate in the first direction to urge the runner 18 downwardly along the worm gear 38. Thus, the umbrella 12 is urged into the stored position. The worm gear 38 facilitates the umbrella 12 to be urged between the deployed position and the stored position without requiring manual manipulation of the umbrella 12. In this way elderly users and other physically limited users can deploy and store the umbrella 12 without the risk of injury.

The external electronic device 110 is plugged into a selected input port for communicating an audio signal to the speaker 112. In this way the speaker 112 may broadcast music stored on the external electronic device 110. Additionally, the external electronic device 110 may be plugged into the electrical outlet 114 for powering the external electronic device 110. The charge port 122 is plugged into the power source 124 for recharging the at least one rechargeable battery 120 whenever the at least one rechargeable battery 120 is depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated umbrella assembly being automatically urged between a deployed position and a stored position wherein said assembly is configured to shade an area without manual manipulation, said assembly comprising:

an umbrella being positionable between a deployed position and a stored position, said umbrella including a plurality of ribs, a canopy being positioned on said ribs, a runner, a top tube, a bottom tube and a plurality of stretchers, said runner having a top end, a bottom end and an interior surface, each of said stretchers being pivotally coupled between said top end of said runner and a respective one of said ribs, said runner being slidably positioned around said top tube for sliding upwardly and downwardly along said top tube when said umbrella is positioned between said deployed position and said stored position, said top tube having a lower end and an inside surface, said bottom tube having an upper end, said lower end of said top tube being spaced from and being aligned with said upper end of said bottom tube;

a worm gear being rotatably coupled to said umbrella for urging said umbrella between said deployed position and said stored position;

a pole having said umbrella being pivotally coupled thereto, said pole having an uppermost end, a lowermost end and an outer wall extending therebetween, said pole being hollow, each of said uppermost end and said lowermost end being open, said uppermost end having a notch extending downwardly towards said lowermost end, said outer wall of said pole having a cut therein, said cut extending around an entire circumference of said pole to define a top portion of said pole and a bottom portion of said pole;

a base insertably receiving said pole such that said umbrella is spaced from said base;

a control circuit being positioned in said pole; and a worm gear motor being coupled to said umbrella, said worm gear being rotatably coupled to said worm gear motor, said worm gear motor being electrically coupled to said control circuit, said worm gear motor rotating said worm gear in a first direction when said worm gear motor is turned on to rotate in a first direction wherein said umbrella is urged into said stored position, said worm gear motor rotating said worm gear in a second direction when said worm gear motor is turned on to rotate in a second direction wherein said umbrella is urged into said deployed position.

2. The assembly according to claim 1, wherein said worm gear extends between said bottom tube and said top tube, said worm gear being rotatable in a first direction and a second direction, said worm gear having a top end and a bottom end, said top end of said worm gear being rotatably coupled to said inside surface of said top tube, said runner threadably engaging said worm gear.

3. The assembly according to claim 2, wherein said runner is urged upwardly along said worm gear when said worm gear is rotated in said first direction for urging said umbrella into said stored position, said runner being urged downwardly along said worm gear when said worm gear is rotated in said second direction for urging said umbrella into said deployed position.

4. The assembly according to claim 3, further comprising a washer having an outer surface and an inner surface, said outer surface being coupled to said interior surface of said runner, said washer being aligned with said bottom end of said runner, said worm gear extending through said washer having said inner surface of said washer threadably engaging said worm gear.

5. The assembly according to claim 1, wherein said base has a bottom surface, a top surface and an outer surface extending therebetween, said outer surface of said base having a plurality of intersecting sides such that said base has an octagonal cross-section taken along a line extending through said bottom surface of said base and said top surface of said base.

6. The assembly according to claim 5, wherein said top surface of said base has a well extending towards said bottom surface, said well being centrally positioned on said top surface, said well insertably receiving said lowermost end of said pole having said pole extending upwardly from said base.

7. The assembly according to claim 1, further comprising a tab being coupled to and extending downwardly from said lower end of said top tube of said umbrella, said tab being positioned in said notch in said uppermost end of said pole, said tab having a distal end with respect to said lower end of said top tube, said distal end being concavely arcuate with respect to said top tube, said distal end comprising a plurality of teeth.

8. The assembly according to claim 7, further comprising a pin extending through said pole and said tab such that said top tube is pivotally coupled to said pole.

9. The assembly according to claim 8, further comprising:

a first gear being positioned within said pole;

a tilt motor having said first gear being rotatably coupled thereto, said tilt motor rotating said first gear in a first direction when said tilt motor is turned on to rotate in a first direction, said tilt motor rotating said first gear in a second direction when said tilt motor is turned on to rotate in a second direction, said tilt motor being electrically coupled to said control circuit; and a second gear engaging said first gear and said teeth on said tab such that said tab rotates about said pin when said tilt motor is turned on for tilting said umbrella.

10. The assembly according to claim 1, further comprising:

a gearbox being positioned in said top portion of said pole and engaging said top portion of said pole; and a rotation motor being positioned in said bottom portion of said pole, said rotation motor being electrically coupled to said control circuit, said rotation motor having said gearbox being rotatably coupled thereto, said gearbox rotating said top portion of said pole about a vertical axis when said rotation motor is turned on wherein said umbrella is configured to be aligned with the sun.

11. The assembly according to claim 1, further comprising a plurality of input ports, each of said input ports being coupled to said outer wall of said pole, each of said input ports being electrically coupled to said control circuit, each of said input ports being configured to be electrically coupled to an external electronic device for receiving data from the external electronic device.

12. The assembly according to claim 11, further comprising a speaker being coupled to said outer wall of said pole, said speaker being electrically coupled to said control circuit to receive the data from said input ports wherein said speaker is configured to emit audible sounds outwardly from said pole.

13. The assembly according to claim 1, further comprising an electrical outlet being coupled to said outer wall of said pole, said electrical outlet being electrically coupled to said control circuit, said electrical outlet being configured to have an external electronic device being electrically coupled thereto for powering the external electronic device.

14. An automated umbrella assembly being automatically urged between a deployed position and a stored position wherein said assembly is configured to shade an area without manual manipulation, said assembly comprising:

an umbrella being positionable between a deployed position and a stored position;

a worm gear being rotatably coupled to said umbrella for urging said umbrella between said deployed position and said stored position;

a pole having said umbrella being pivotally coupled thereto;

a base insertably receiving said pole such that said umbrella is spaced from said base;

a control circuit being positioned in said pole;

a worm gear motor being coupled to said umbrella, said worm gear being rotatably coupled to said worm gear motor, said worm gear motor being electrically coupled to said control circuit, said worm gear motor rotating said worm gear in a first direction when said worm gear motor is turned on to rotate in a first direction wherein said umbrella is urged into said stored position, said worm gear motor rotating said worm gear in a second direction when said worm gear motor is turned on to rotate in a second direction wherein said umbrella is urged into said deployed position; and a power supply being positioned within said base, said power supply being electrically coupled said control circuit, said power supply comprising at least one rechargeable battery being positioned within said base, said at least one rechargeable battery being electrically coupled to said control circuit; and a charge port being coupled to said base wherein said charge port is configured to be electrically coupled to a power source, said charge port being electrically coupled to said at least one rechargeable battery for charging said at least one rechargeable battery.

15. An automated umbrella assembly being automatically urged between a deployed position and a stored position wherein said assembly is configured to shade an area without manual manipulation, said assembly comprising:

an umbrella being positionable between a deployed position and a stored position, said umbrella including a plurality of ribs, a canopy being positioned on said ribs, a runner, a top tube, a bottom tube and a plurality of stretchers, said runner having a top end, a bottom end and an interior surface, each of said stretchers being pivotally coupled between said top end of said runner and a respective one of said ribs, said runner being slidably positioned around said top tube for sliding upwardly and downwardly along said top tube when said umbrella is positioned between said deployed position and said stored position, said top tube having a lower end and an inside surface, said bottom tube having an upper end, said lower end of said top tube being spaced from and being aligned with said upper end of said bottom tube;

a worm gear being rotatably coupled to said umbrella for urging said umbrella between said deployed position and said stored position, said worm gear extending between said bottom tube and said top tube, said worm gear being rotatable in a first direction and a second direction, said worm gear having a top end and a bottom end, said top end of said worm gear being rotatably coupled to said inside surface of said top tube, said runner threadably engaging said worm gear, said runner being urged upwardly along said worm gear when said worm gear is rotated in said first direction for urging said umbrella into said stored position, said runner being urged downwardly along said worm gear when said worm gear is rotated in said second direction for urging said umbrella into said deployed position;

a washer having an outer surface and an inner surface, said outer surface being coupled to said interior surface of said runner, said washer being aligned with said bottom end of said runner, said worm gear extending through said washer having said inner surface of said washer threadably engaging said worm gear;

a pole having said umbrella being pivotally coupled thereto, said pole having an uppermost end, a lowermost end and an outer wall extending therebetween, said pole being hollow, each of said uppermost end and said lowermost end being open, said uppermost end having a notch extending downwardly towards said lowermost end, outer wall of said pole having it cut therein, said cut extending around an entire circumference of said pole to define a top portion of said pole and a bottom portion of said pole;

a base insertably receiving said pole such that said umbrella is spaced from said base, said base having a bottom surface, a top surface and an outer surface extending therebetween, said outer surface of said base having a plurality of intersecting sides such that said base has an octagonal cross-section taken along a line extending through said bottom surface of said base and said top surface of said base, said top surface of said base having a well extending towards said bottom surface, said well being centrally positioned on said top surface, said well insertably receiving said lowermost end of said pole having said pole extending upwardly from said base;

a control circuit being positioned in said pole;

a worm gear motor being positioned within said bottom tube, said bottom end of said worm gear being rotatably coupled to said worm gear motor, said worm gear motor being electrically coupled to said control circuit, said worm gear motor rotating said worm gear in said first direction when said worm gear motor is turned on to rotate in a first direction, said worm gear motor rotating said worm gear in said second direction when said worm gear motor is turned on to rotate in a second direction;

a tab being coupled to and extending downwardly from said lower end of said top tube of said umbrella, said tab being positioned in said notch in said uppermost end of said pole, said tab having a distal end with respect to said lower end of said top tube, said distal end being concavely arcuate with respect to said top tube, said distal end comprising a plurality of teeth;

a pin extending through said pole and said tab such that said top tube is pivotally coupled to said pole;

a first gear being positioned within said pole;

a tilt motor having said first gear being rotatably coupled thereto, said tilt motor rotating said first gear in a first direction when said tilt motor is turned on to rotate in a first direction, said tilt motor rotating said first gear in a second direction when said tilt motor is turned on to rotate in a second direction, said tilt motor being electrically coupled to said control circuit;

a second gear engaging said first gear and said teeth on said tab such that said tab rotates about said pin when said tilt motor is turned on for tilting said umbrella;

a gearbox being positioned in said top portion of said pole and engaging said top portion of said pole;

a rotation motor being positioned in said bottom portion of said pole, said rotation motor being electrically coupled to said control circuit, said rotation motor having said gearbox being rotatably coupled thereto, said gearbox rotating said top portion of said pole about a vertical axis when said rotation motor is turned on wherein said umbrella is configured to be aligned with the sun;

a plurality of input ports, each of said input ports being coupled to said outer wall of said pole, each of said input ports being electrically coupled to said control circuit, each of said input ports being configured to be electrically coupled to an external electronic device for receiving data from the external electronic device;

a speaker being coupled to said outer wall of said pole, said speaker being electrically coupled to said control circuit to receive the data from said input ports wherein said speaker is configured to emit audible sounds outwardly from said pole;

an electrical outlet being coupled to said outer wall of said pole, said electrical outlet being electrically coupled to said control circuit, said electrical outlet being configured to have an external electronic device being electrically coupled thereto for powering the external electronic device; and a power supply being positioned within said base, said power supply being electrically coupled said control circuit, said power supply comprising:

at least one rechargeable battery being positioned within said base, said at least one rechargeable battery being electrically coupled to said control circuit; and a charge port being coupled to said base wherein said charge port is configured to be electrically coupled to a power source, said charge port being electrically coupled to said at least one rechargeable battery for charging said at least one rechargeable battery.

* * * * *